United States Patent [19]

Kelley

[11] Patent Number: 5,057,984

[45] Date of Patent: Oct. 15, 1991

[54] LIGHT WEIGHT LIGHTING PANEL

[75] Inventor: David M. Kelley, Fenton, Mo.

[73] Assignee: K-S-H, Inc., St. Louis, Mo.

[21] Appl. No.: 668,391

[22] Filed: Mar. 13, 1991

Related U.S. Application Data

[63] Continuation of Ser. No. 545,105, Jun. 27, 1990, abandoned, which is a continuation of Ser. No. 821,220, Jan. 21, 1986, abandoned, which is a continuation of Ser. No. 525,054, Aug. 22, 1983, abandoned.

[51] Int. Cl.[5] ..... F21V 5/00; F21V 5/02

[52] U.S. Cl. ..... 362/330; 362/339

[58] Field of Search ..... 362/330, 339; 350/261; D26/122

[56] References Cited

U.S. PATENT DOCUMENTS

| | | | |
|---|---|---|---|
| D. 18,705 | 10/1988 | Brogan et al. . | |
| D. 78,031 | 11/1927 | Kopp . . | |
| D. 158,193 | 8/1949 | Hood . | |
| D. 173,157 | 10/1954 | Hurley | D26/122 |
| D. 184,722 | 3/1959 | Franck et al. | D26/122 |
| D. 201,822 | 8/1965 | Meyer | D26/122 |
| D. 223,386 | 4/1972 | Stahlhut | D26/122 |
| 1,524,998 | 4/1923 | Russell . | |
| 2,242,872 | 5/1941 | Rolph | 362/330 |
| 2,474,317 | 6/1949 | McPhail | 362/339 |
| 2,859,334 | 11/1958 | Guth | D26/122 |
| 3,038,065 | 6/1962 | Franck et al. | D26/122 |
| 3,093,323 | 6/1963 | Guth | 362/330 |
| 3,150,833 | 9/1964 | Franck et al. | 362/330 |
| 3,578,967 | 5/1971 | Stahlhut et al. | 350/261 |
| 3,624,388 | 11/1971 | Schwartz et al. | 362/330 |
| 3,760,178 | 9/1973 | Miller | 362/223 |
| 4,064,433 | 12/1977 | Korn | 362/330 |
| 4,332,005 | 5/1982 | McCall | 362/150 |

FOREIGN PATENT DOCUMENTS

| | | | |
|---|---|---|---|
| 1040272 | 1/1955 | France | 362/330 |

OTHER PUBLICATIONS

"K-11 Lighting of Distinction", Brochure, K-S-14 Plastics Inc., MO., 63122, Copyright 1963.

"KSH 12 Lens", (Brochure), K-S-H, Inc., Copyright 1974.

*Primary Examiner*—Raymond A. Nelli

*Attorney, Agent, or Firm*—Polster, Polster & Lucchesi

[57] ABSTRACT

A prismatic lighting panel of very low weight (less than four ounces per square foot), high strength, and good optical characteristics includes a grid of depending thin ribs on one inch centers, and a web of microprisms between the ribs.

3 Claims, 1 Drawing Sheet

LIGHT WEIGHT LIGHTING PANEL

This is a continuation application of copending application Ser. No. 07/545,105, filed on June 27, 1990, now abandoned, which is a continuation of application Ser. No. 06/821,220, filed on Jan. 21, 1986, now abandoned, which is a continuation of application Ser. No. 525,054, filed on Aug. 22, 1983, now abandoned.

BACKGROUND OF THE INVENTION

This invention relates to lighting panels of the sort used in distributing light from a light source. Prismatic lighting panels are widely used in overhead fluorescent lighting fixtures, and may be used with other light sources. Their primary purpose is to reduce direct glare by controlling the angle at which light emerges from the panel.

The theory of prismatic lighting panels is well known, and is discussed, for example, in McPhail, U.S. Pat. No. 2,474,317. Such panels include a planar upper face and a lower face covered with prismatic elements. Light rays entering the top of the panel are either refracted downward through the lower surface of the panel at useful angles to the vertical (i.e. the normal of the panel), or are reflected internally by the prismatic elements upward through the upper surface of the panel. If the prismatic elements have straight sides which make the proper angle with the normal of the panel, virtually all of the light which would otherwise emerge at high angles relative to the normal of the panel is internally reflected by the prisms and high angle "direct" glare is thereby greatly reduced or eliminated.

A particularly popular prismatic lighting panel has, on its lower surface, female conical prisms, the apexes of which are aligned along 45° diagonals to the edges of the panel and spaced three-sixteenths of an inch (0.50+/−0.05 centimeters) on centers. The intersections of the cones thus form a structure of square cells, all of whose sides lie along lattice lines running at angles of 45° to the edges of the panel. An example of such a lighting panel is one sold by K-S-H, Inc., under the trademark KSH-12. For convenience, a panel having this pattern will be referred to herein as "the usual" panel.

In recent years there has been an increasing demand for inexpensive prismatic lighting panels. Because the plastic material of which the panels are made represents the major cost of prismatic lighting panels, the usual prismatic panel has been made ever thinner, until presently it has reached the limit permitted by its geometry. Because the apex angle of the female prisms is critical to the optical performance of the panel, the height of the prisms is a function of the size of the individual cells of the prismatic pattern, that is, the spacings between apexes of the cones. Although it is theoretically possible to reduce the size of the cells below the three-sixteenths inch side of the usual panel, both aesthetic considerations and manufacturing constraints have made any substantial decrease in cell size impractical. More importantly, further reduction in cell size and panel thickness produces such a flimsy panel that it sags noticeably in a standard two-foot by four-foot lighting fixture. Other techniques for reducing the amount of material in a panel have been attempted, such as increasing the apex angle of the female cones or "hogging out" the prisms so that their surfaces are concave rather than linear in cross section, but these techniques yield only limited savings of material and tend to degrade the optical performance of the panel. Using presently known techniques, commercially available embodiments of the usual panel have been reduced to an overall thickness of about 0.093 inch (0.236 centimeters), and have been made as light as 5.4 ounces per square foot (1650 grams per square meter.)

SUMMARY OF THE INVENTION

One of the objects of this invention is to provide a prismatic lighting panel which has optical characteristics comparable with those of presently known light-weight embodiments of the usual panel, and which may be substantially lighter in weight than such panels.

Another object is to provide such a panel which is stronger and more resistant to sag than presently known light-weight embodiments of the usual panel.

Another object is to provide such a panel which is elegant and appealing in appearance.

Another object is to provide such a panel which breaks up lamp images as viewed from below a fluorescent fixture.

Other objects will occur to those skilled in the art in light of the following description and accompanying drawings.

In accordance with this invention, generally stated, a light-weight lighting panel is provided which includes a thin web portion of small prismatic elements, and a grid of depending thin ribs, the panel having sufficient strength that a two-by-four foot panel resists sagging, and an overall weight of less than four ounces per square foot.

In the preferred embodiment, the lower face of the web portion includes a pattern of female conical prisms. The prisms have an apex angle of about 112° and are 0.065+/−0.01 inches on a side. The prisms are arranged to intersect one another in a square pattern arranged at an angle of forty-five degrees to the grid. The web portion has a maximum thickness of from about 0.01 inches at the apex of the conical prisms to about 0.04 inches at the corners of intersection of the prisms. The web portion would not be self-supporting over a span of several inches, and would sag so badly over a span of a foot that a panel formed entirely of the web portion would sag and fall out of a lighting fixture.

The ribs making up the grid have a height of about 0.13 inches from the upper face of the panel. The ribs taper about six degrees inwardly from the normal to the panel, and at their lower, distal, edge they taper inwardly at an angle of forty-five degrees to a sharp edge. The lower taper provides a bright strip when the panel is lighted from above. The ribs have a width at their root of about 0.062 inches.

The preferred panel of the present invention, when made in acrylic, has a weight on the order of 3.5 ounces per square foot, yet has a strength nearly equal to that of a full one-eighth inch thick usual panel weighing approximately twice as much per square foot. Because of its light weight, the panel is less likely to sag under its own weight.

Other aspects of the invention are best understood with respect to the preferred embodiment of the panel.

DESCRIPTION OF THE PREFERRED EMBODIMENT

Figure 1:
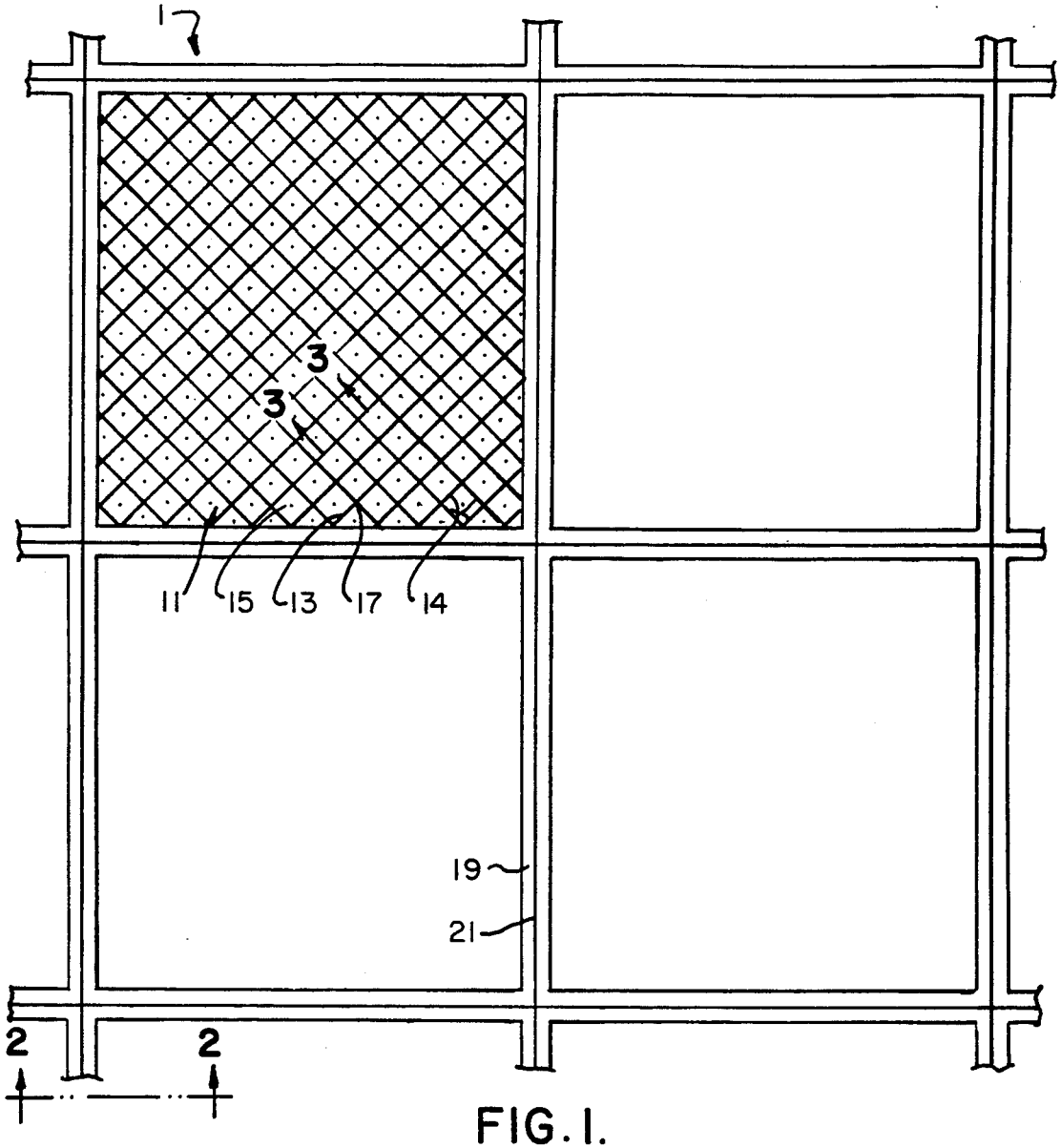
FIG. 1 is a fragmentary lower plan view of a lighting panel of the present invention, shown enlarged.

Referring now to the drawing, reference numeral 1 indicates a light-weight prismatic panel of the present invention, a small section of which is shown enlarged in FIG. 1. The panel 1 is made of optically clear stabilized polystyrene having a specific gravity of 1.04. The panel 1 includes a thin web portion 3 and a square grid of depending thin ribs 5.

The upper face 7 of the web portion 3 is planar and optically clear. The lower face 9 of the web portion 3 includes a pattern of female conical micro-prisms 11. The micro-prisms 11 have an apex angle of 112°. The micro-prisms 11 are arranged in such a manner that the depending lines 13 of intersection of the prisms 11 form a pattern of squares 14. The squares 14 are 0.065 inches on a side, and are arranged at an angle of forty-five degrees to the grid of ribs 5.

The web portion 3 has a thickness of 0.01 inches at the apexes 15 of the conical prisms 11 and a thickness of 0.04 inches at the corners 17 of the lines 13 of intersection of the prisms 11. The web portion 3 is not self-supporting, without noticeable sag, over a span of even several inches.

Figure 2:
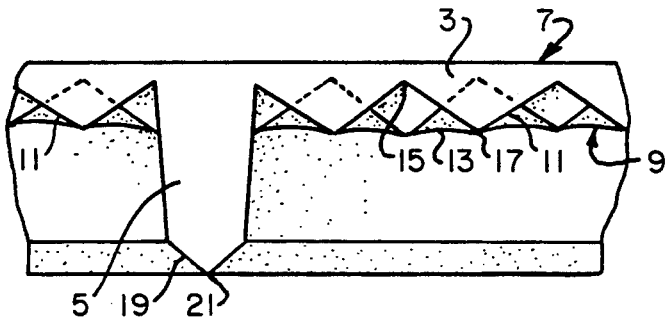
FIG. 2 is a view along the line 2—2 of FIG. 1 of the panel of FIG. 1, further enlarged to show details of the construction thereof.
Figure 3:
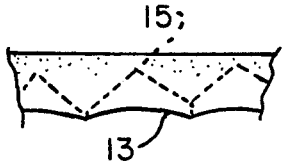
FIG. 3 is a fragmentary sectional view, taken along the line 3—3 of FIG. 1.

The ribs 5 making up the grid have a height of 0.125 inches from the upper face of the panel. The ribs 5 taper six degrees inwardly from the normal to the panel to aid in producing the panel, and at their lower, distal, edge the ribs 5 taper inwardly, as shown at 19 in FIG. 2, at an angle of forty-five degrees to a sharp edge 21. The lower taper 19 provides a bright strip when the panel is lighted from above. The ribs 5 have a width at their root of 0.062 inches.

The preferred panel of the present invention has a weight of substantially less than 3.5 ounces per square foot, approaching three ounces per square foot. When made in acrylic, it has a weight on the order of 3.5 ounces per square foot. In either material, however, the panel of the present invention has a strength nearly equal to that of a full one-eighth inch thick usual panel weighing approximately twice as much per square foot. Because of its light weight, the panel does not sag perceptibly under its own weight.

The panel 1 is preferably made by extruding a panel either four feet wide or two feet wide, using the usual forming rolls, and cutting it to length.

Numerous variations in the lighting panel of the present invention, within the scope of the appended claims, will occur to those skilled in the art in light of the foregoing disclosure. For example, the sizes of the prisms may be varied somewhat, and the size of the grid may be varied somewhat, without greatly sacrificing the weight, aesthetic, optical, and strength benefits of the preferred embodiment. The lower edges 19 of the ribs may be painted or otherwise embellished for aesthetic purposes and to reduce high angle brightness.

I claim:

1. A light-weight, substantially flat lighting panel for use under a light source, the panel being made of light-transmitting thermoplastic material and having an upper face and a lower face, said upper face having a transparent surface, said panel comprising a thin web portion having on its lower face pattern means for breaking up images, said web portion being so thin that a two-by-four foot panel formed entirely of the web portion would sag in a lighting fixture, and means for stiffening said panel sufficiently that a two-by-four foot panel resists sagging and may be used in a lighting fixture, said stiffening means consisting essentially of a grid of depending thin ribs on the lower face of the panel and formed integrally with the web portion of the panel, the ribs having transparent downwardly converging side walls for providing bright strips when the panel is lighted from above.

2. The panel of claim 1 wherein the pattern means on the lower face of the web portion comprise a pattern of optical cut-off prisms.

3. The panel of claim 1 wherein the ribs making up the grid have a height of about 0.13+/−0.05 inches from the upper face of the panel, the ribs forming a square lattice having a side of about one inch between intersections.

* * * * *